US007724876B2

(12) United States Patent
Nose et al.

(10) Patent No.: US 7,724,876 B2
(45) Date of Patent: May 25, 2010

(54) MULTI-COLOR X-RAY GENERATOR

(75) Inventors: Hiroyuki Nose, Tokyo (JP); Daisuke Ishida, Tokyo (JP); Namio Kaneko, Tokyo (JP); Hisaharu Sakae, Tokyo (JP); Mitsuru Uesaka, Tokyo (JP); Katsuhiro Dobashi, Chiba (JP)

(73) Assignees: IHI Corporation, Tokyo (JP); The University of Tokyo, Tokyo (JP); National Institute of Radiological Sciences, Chiba (JP)

( * ) Notice: Subject to any disclaimer, the term of this patent is extended or adjusted under 35 U.S.C. 154(b) by 224 days.

(21) Appl. No.: 11/913,975

(22) PCT Filed: May 11, 2006

(86) PCT No.: PCT/JP2006/309504

§ 371 (c)(1),
(2), (4) Date: Nov. 9, 2007

(87) PCT Pub. No.: WO2006/121126

PCT Pub. Date: Nov. 16, 2006

(65) Prior Publication Data

US 2009/0252296 A1 Oct. 8, 2009

(30) Foreign Application Priority Data

May 12, 2005 (JP) ..... 2005-139726

(51) Int. Cl.
*H01J 35/00* (2006.01)

(52) U.S. Cl. ..... 378/119

(58) Field of Classification Search ..... 378/119, 378/121, 138, 210; 315/500, 503, 505; 372/2
See application file for complete search history.

(56) References Cited

U.S. PATENT DOCUMENTS 6,332,017 B1 12/2001 Carroll et al.

(Continued)

FOREIGN PATENT DOCUMENTS

JP 08-096986 4/1996

(Continued)

OTHER PUBLICATIONS

Dohashi, Katsunori, et al., "Development of Small-Sized Hard X-Ray Source using X-band Liniac," 2002. in Japanese).

(Continued)

*Primary Examiner*—Jurie Yun
(74) *Attorney, Agent, or Firm*—Griffin & Szipl, P.C.

(57) ABSTRACT

A multi-color X-ray generator includes an electron beam generator 10 which accelerates an electron beam to generate a pulse electron beam 1 and which transmits the beam along a predetermined rectilinear orbit 2, a composite laser generator 20 which successively generates a plurality of pulse laser lights 3*a*, 3*b* having different wavelengths, and a laser light introduction device 30 which introduces the pulse laser lights along the rectilinear orbit 2 to be opposed to the pulse electron beam 1, so that the plurality of pulse laser lights 3*a*, 3*b* successively head-on collide with the pulse electron beam 1 along the rectilinear orbit 2 so as to generate two or more types of monochromatic hard X-rays 4 (4*a*, 4*b*).

5 Claims, 5 Drawing Sheets

U.S. PATENT DOCUMENTS 7,027,553 B2 * 4/2006 Dunham et al. ..... 378/5

FOREIGN PATENT DOCUMENTS

| | | | |
|---|---|---|---|
| JP | 08-206103 | | 8/1996 |
| JP | 09-129396 | | 5/1997 |
| JP | 11-264899 | * | 9/1999 |
| JP | 2001-133600 | | 5/2001 |
| JP | 2001-176694 | | 6/2001 |
| JP | 2002-280200 | | 9/2002 |
| JP | 2003-038475 | | 2/2003 |
| JP | 2003-151800 | | 5/2003 |

OTHER PUBLICATIONS

Sasaki, M., et al., "Development of Mixed Dual-Energy X-Ray CT System," Medical Physics vol. 23, Supplement No. 2, Apr. 2003, pp. 158-161.

International Search Report issued in corresponding application No. PCT/JP2006/309504, completed Aug. 3, 2006 and mailed Aug. 15, 2006.

* cited by examiner

MULTI-COLOR X-RAY GENERATOR

This is a National Phase Application in the United States of International Patent Application No. PCT/JP2006/309504 filed May 11, 2006, which claims priority on Japanese Patent Application No. 139726/2005, filed May 12, 2005. The entire disclosures of the above patent applications are hereby incorporated by reference.

BACKGROUND OF THE INVENTION

1. Field of the Invention

The present invention relates to a multi-color X-ray generator which successively switches and generates two or more types of monochromatic hard X-rays at short time intervals 2. Description of the Related Art X-rays are electromagnetic waves having a wavelength of about 0.1 to 100 A ($10^{-11}$ to $10^{-8}$ m), among the rays, an X-ray having a short wavelength (10 to 100 keV, $\lambda$=1 to 0.1 A) is referred to as a hard X-ray, and an X-ray having a long wavelength (0.1 to 10 keV, $\lambda$=100 to 1 A) is referred to as a soft X-ray. Moreover, an X-ray emitted at a time when an electron beam or the like is struck on a substance and having a wavelength inherent in a constituting element of the substance is referred to as a particular X-ray.

As apparatuses in which the X-rays are used, an X-ray transmission apparatus, an X-ray CT apparatus, an X-ray diffraction apparatus, an X-ray spectral apparatus and the like are utilized in broad fields such as a medical treatment, bioscience and material science. For example, to cure cardiac infarction, coronary angiography (IVCAG) in which an X-ray of about 50 keV is used is generally performed. Moreover, the X-ray CT apparatus is an apparatus in which an object to be measured is irradiated with X-rays from different directions to measure absorption of the rays, and an image is reconstructed by a computer to obtain a two-dimensional sectional image of the object.

As generation sources of the X-rays, an X-ray tube and synchrotron radiation light are known.

The X-ray tube is a device in which a thermion obtained by heating a filament in vacuum is accelerated at a high voltage, and is allowed to collide with a metal anode (a target), thereby generating the X-ray. Examples of the X-ray to be generated from the X-ray tube include a continuous X-ray obtained by braking radiation of an electron, and a particular X-ray which is a bright line spectrum. The continuous X-ray is used as a ray source for an application in which any X-ray having a specific wavelength is not required, for example, a transmission process for a medical treatment or industry. The particular X-ray is used for an application in which the X-ray having the specific wavelength is required, for example, X-ray diffraction, fluorescent X-ray spectroscopy or the like.

On the other hand, the synchrotron radiation light (SR light) is an X-ray generated during an orbit change in a case where an orbit of the electron beam accelerated at a speed close to a light speed is changed by a strong magnet in an annular accelerator (a synchrotron). The SR light is an X-ray source (e.g., an X-ray intensity (a photon number): about $10^{14}$ photons/s, a pulse width: about 100 ps) which is incommensurably ($10^3$ times or more) intense as compared with the X-ray tube, and the ray is used for a field in which a high X-ray intensity is required.

However, a synchrotron radiation light facility in which a synchrotron is used is a large-sized facility in which the synchrotron has a large diameter of about 50 m or more and an orbit length reaches 100 m or more, and there is therefore a problem that the facility even for a research or the medical treatment cannot easily be introduced. To solve the problem, a small-sized X-ray generation device is proposed in which a small-sized linear accelerator is used (e.g., Non-Patent Document 1).

On the other hand, in a conventional X-ray CT apparatus, a monochromatic meter including two crystal plates is used as means for obtaining a monochromatic hard X-ray from the radiation light. Since the monochromatic X-ray CT apparatus has a low measurement precision of an electron density, a mixed two-color X-ray CT apparatus is proposed in which two types of X-rays having different mixture ratios of a dominant wave and a higher harmonic wave are used (e.g., Non-Patent Document 2).

In addition, as means for generating two types of X-rays, Patent Documents 1, 2 have already been disclosed.

In "Small-Sized X-Ray Generation Device" of Non-Patent Document 1, as shown in FIG. 1, an electron beam 52 accelerated by a small-sized accelerator 51 (an X-band acceleration tube) is allowed to collide with laser 53 to generate an X-ray 54. The multi-bunch electron beam 52 generated by an RF electron gun 55 (a thermal RF gun) is accelerated by the X-band acceleration tube 51, and collides with the pulse laser light 53. The hard X-ray 54 having a time width of 10 ns is generated by Compton scattering.

This device is miniaturized by using, as an RF, an X-band (11.424 GHz) corresponding to a frequency four times as high as that of an S-band (2.856 GHz) for general use in a linear accelerator, and it is predicted that the hard X-ray having, for example, an X-ray intensity (the photon number) of about $1\times10^9$ photons/s and a pulse width of about 10 ps is generated.

As shown in FIG. 2, "Mixed Two-Color X-Ray CT Apparatus" of Non-Patent Document 2 includes a rotary filter 61, a monochromatic meter 62, a collimator 63, a transmission type ion chamber 64, a scattering member 65, a sliding rotary table 66, an NaI detector 67 and a plastic scintillation counter 68. A dominant wave X-ray of 40 keV and a double higher harmonic wave X-ray of 80 keV are extracted from synchrotron radiation light 69*a* by the monochromatic meter 62, a mixture ratio of the 40 keV X-ray and the 80 keV X-ray is regulated by the rotary filter 61, scattered X-ray spectrum from the scattering member 65 is observed by the NaI detector 67 to measure the mixture ratio, a size of a mixed two-color X-ray 69*b* is adjusted by the collimator 63, the ray is transmitted through the transmission type ion chamber 64 and a subject 60, and an intensity of the ray is measured by the plastic scintillation counter 68.

According to this apparatus, the measurement precision of the electron density is improved, and the apparatus is successful in preparation of an image indicating the electron density and an effective atomic number.

As shown in FIG. 3, "X-Ray Generation Device" of Patent Document 1 has a microtron 73 which defines a plurality of electron circulation orbits partially shared and which is provided with an accelerator 72 to increase and reduce energy of an electron beam 71 in the shared part of the orbits, an electron beam source 74 which strikes the electron beam 71 on the electron circulation orbit of the microtron, and a laser light source 76 which emits a laser light 75 so that the laser light collides with an electron that flies at the shared part of the orbit of the microtron.

As shown in FIGS. 4A to 4C, "X-ray Generation Device" of Patent Document 2 has an electron beam source 82 which emits a pulse-like electron beam 81, and laser optical systems 85A, 85B which emit first and second laser lights 83A, 83B in a pulse-like manner in synchronization with the emission of the pulse-like electron beam so that the laser lights collide with the pulse-like electron beam emitted from the electron beam source.

[Non-Patent Document 1]

"Development of Small-Sized Hard X-Ray Source using X-band Liniac", 2002, authored by Katsuhiro DOHASHI, et al.

[Non-Patent Document 2]

"Development of Mixed Two-Color X-Ray CT System" authored by Makoto SASAKI, et al., Medical Physics Vol. 23 Supplement No. 2 Apr. 2003

[Patent Document 1]

Japanese Patent Application Laid-Open No. 2002-280200 titled "X-Ray Generation Device and Generation Method"

[Patent Document 2]

Japanese Patent Application Laid-Open No. 11-264899 titled "Electron/Laser Collision Type X-Ray Generation Device and X-ray Generation Method"

In angiography by a difference process and two-color X-ray CT, a switch speed of X-ray energy is important. For example, in dynamic angiography, the energy needs to be switched to obtain an image in a short time to such an extent that it can be judged that a blood vessel does not move. In the two-color X-ray CT, if much time is required for the switching of the energy, there is a problem that a state of a subject changes and a quality of the reconstructed image drops.

To obtain the monochromatic hard X-rays from the radiation light by use of the monochromatic meter, since the monochromatic meter includes two crystal plates as described in Non-Patent Document 2, two types of monochromatic meters need to be used to obtain two types of monochromatic hard X-rays (the two-color X-ray). However, in the monochromatic meter, since a crystal angle needs to be precisely adjusted, it is very difficult to switch the monochromatic meter in the short time.

Moreover, even in another X-ray source in which the particular X-ray is used as a monochromatic X-ray, the target needs to be switched physically, and it is also difficult to switch the target at the high speed.

Furthermore, in a case where the mixed two-color X-ray obtained by mixing the dominant wave X-ray and the double higher harmonic wave X-ray are mixed is extracted from the synchrotron radiation light as in Non-Patent Document 2, the wavelength of the X-ray is limited to that of the higher harmonic wave, and there is also a problem that the dominant wave cannot be separated from the higher harmonic wave.

In addition, in "X-ray Generation Device" of Patent Document 1, the wavelength of the laser light cannot be switched in the short time.

Moreover, "X-ray Generation Device" of Patent Document 2 has problems that the device has a small collision probability between the pulse-like electron beam and the first and second laser lights and a low X-ray generation output.

To solve the above problems, the present invention has been developed. That is, an object of the present invention is provide a multi-color X-ray generator capable of successively switching and generating a plurality of (two, three or more types) monochromatic hard X-rays at short time intervals to such an extent that it can be judged that a blood vessel does not move and capable of generating an intense X-ray applicable to angiography or the like.

SUMMARY OF THE INVENTION

According to the present invention, there is provided a multi-color X-ray generator comprising:

an electron beam generator which accelerates a pulse electron beam to transmit the pulse electron beam along a predetermined rectilinear orbit;

a composite laser generator which successively generates a plurality of pulse laser lights having different wavelengths; and a laser light introduction device which introduces the plurality of pulse laser lights along the rectilinear orbit to collide with the pulse electron beam, wherein the plurality of pulse laser lights are allowed to head-on collide with the pulse electron beam along the rectilinear orbit to generate two or more types of monochromatic hard X-rays.

According to a preferable embodiment of the present invention, the composite laser generator has a plurality of pulse laser units which generate the plurality of pulse laser lights having the different wavelengths, a laser combining optical system which combines the plurality of pulse laser lights along the same optical path, and a laser control unit which controls the plurality of pulse laser units so that the plurality of pulse laser lights have a time difference.

Moreover, it is preferable to have a profile regulation optical system which regulates a beam profile of the pulse laser light at a collision point along the rectilinear orbit.

It is preferable that the composite laser generator has a laser circulation system which circulates the pulse laser light transmitted along the rectilinear orbit along an optical path before the transmission along the rectilinear orbit, whereby the same pulse laser light is circulated to collide with the pulse electron beam a plurality of times.

It is preferable to have a laser amplifier which amplifies the pulse laser light along the optical circulation path.

According to the above-mentioned constitution of the present invention, the plurality of pulse laser lights generated by the composite laser generator are introduced so as to collide with the pulse electron beam along the rectilinear orbit. Therefore, the plurality of pulse laser lights successively can head-on collide with the pulse electron beam generated by the electron beam generator to successively generate the monochromatic hard X-rays.

Moreover, a wavelength of the X-ray generated by the collision of the pulse electron beam with the pulse laser light is determined depending on a wavelength of laser light. When the plurality of pulse laser lights having the different wavelengths are generated by the composite laser generator, two or more types of monochromatic hard X-rays can successively be switched and generated at short time intervals.

Furthermore, since the pulse laser lights head-on collide with the pulse electron beam along the rectilinear orbit to generate the monochromatic hard X-rays, collision efficiency can be maximized.

For example, to allow the electron beam to collide with the laser light, when the laser lights having a plurality of types of wavelengths are alternately emitted to collide with the electron beam, two colors of X-rays can alternately be generated with high collision efficiency.

Moreover, since the pulse laser units can generate the pulse laser lights in a short period (e.g., 10 pps or more), the laser control unit controls the plurality of pulse laser lights have a time difference. In consequence, the plurality of pulse laser lights are allowed to successively head-on collide with the pulse electron beam in a short period, and two or more types of monochromatic hard X-rays can successively be switched and generated in the short period (e.g., 10 pps or more).

Therefore, the wavelengths of the X-rays can successively be switched at high speed without physically moving any device or component, a change of a wavelength switch time of a subject can be suppressed and satisfactorily precise image pickup can be performed.

Moreover, since the wavelength of the X-ray linearly depends on that of the laser light, timing and energy of the X-ray to be emitted can be specified. Therefore, in an X-ray detector, the images of two-color energy can alternately be shot.

DESCRIPTION OF THE PREFERRED EMBODIMENT

Figure 1:
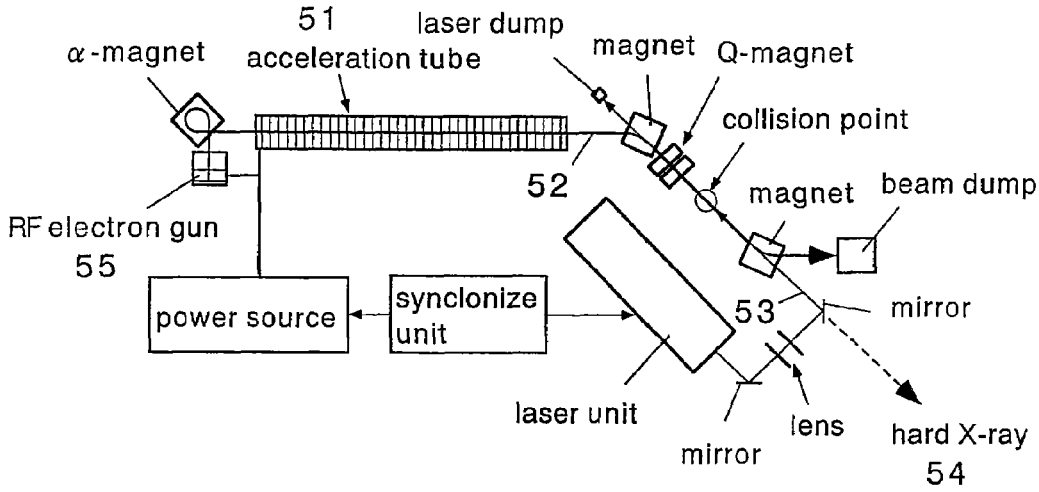
Fig.1 Prior Art
FIG. 1 is a schematic diagram of "Small-Sized X-Ray Generation Device" of Non-Patent Document 1.
Figure 2:
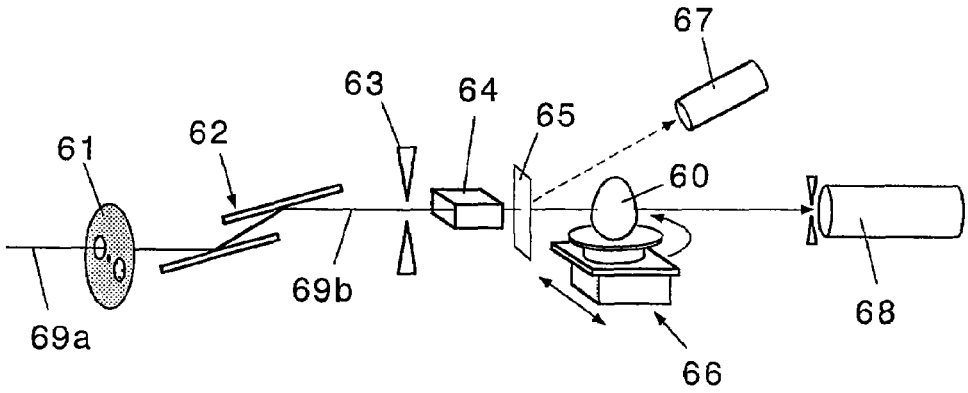
Fig.2 Prior Art
FIG. 2 is a schematic diagram of "Mixed Two-Color X-Ray CT Device" of Non-Patent Document 2.
Figure 3:
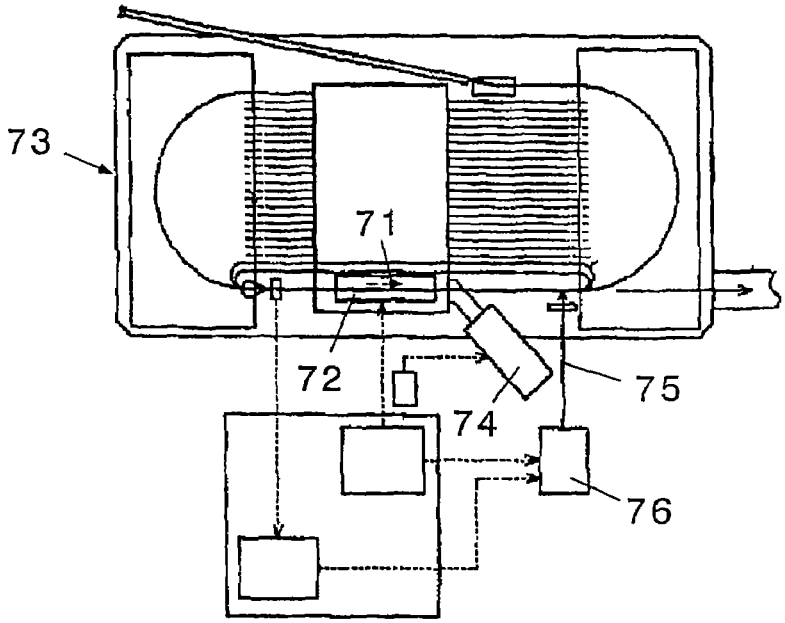
Fig.3 Prior Art
FIG. 3 is a schematic diagram of "X-Ray Generation Device" of Patent Document 1.
Figure 4A:
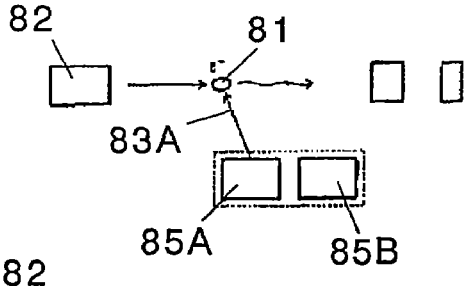
Fig.4A Prior Art
FIGS. 4A to 4C are schematic diagrams of "X-Ray Generation Device" of Patent Document 2.
Figure 4B:
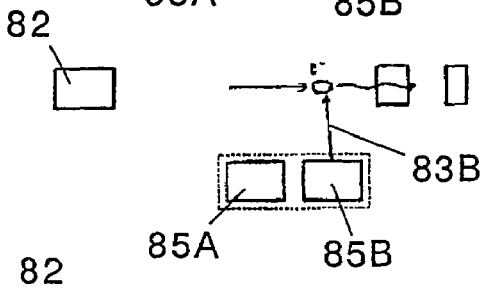
Fig.4B Prior Art
Figure 4C:
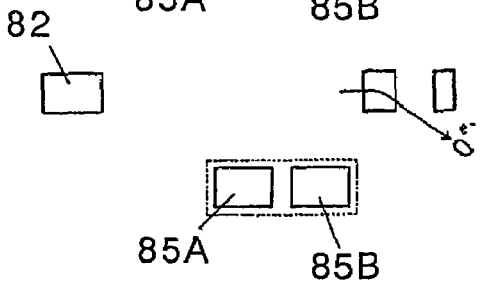
Fig.4C Prior Art

A preferable embodiment of the present invention will hereinafter be described with reference to the drawings. It is to be noted that, in the drawings, common parts are denoted with the same reference numerals, and redundant description thereof is omitted.

Figure 5:
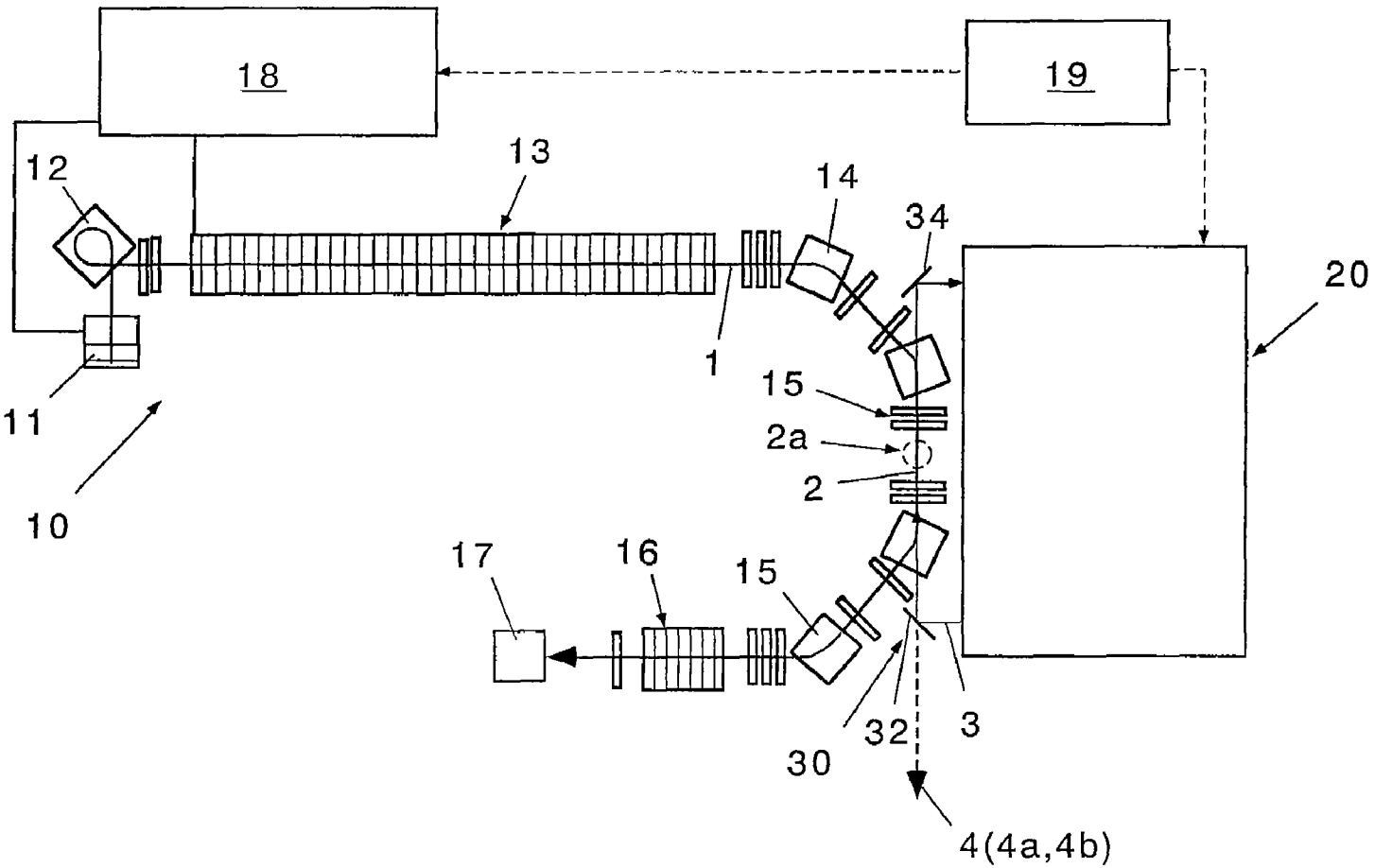
FIG. 5 is a diagram of a first embodiment of a multi-color X-ray generator according to the present invention.

FIG. 5 is a diagram of a first embodiment of a multi-color X-ray generator according to the present invention. As shown in this drawing, the multi-color X-ray generator of the present invention includes an electron beam generator 10, a composite laser generator 20 and a laser light introduction device 30.

The electron beam generator 10 has a function of accelerating an electron beam to generate a pulse electron beam 1, and transmitting the beam along a predetermined rectilinear orbit 2.

In this example, the electron beam generator 10 includes an RF electron gun 11, an α-magnet 12, an acceleration tube 13, a pending magnet 14, Q-magnets 15, a deceleration tube 16 and a beam dump 17.

The RF electron gun 11 and the acceleration tube 13 are driven by a high-frequency power source 18 of an X-band (11.424 GHz). An orbit of the electron beam drawn from the RF electron gun 11 is changed by the cc-magnet 12, and the beam then enters acceleration tube 13. The acceleration tube 13 is a small-sized X-band acceleration tube which accelerates the electron beam to generate a high-energy electron beam of preferably about 50 MeV. This electron beam is the pulse electron beam 1 of, for example, about 1 μs.

Especially, to allow circulating laser to collide with one electron mass, a large electron beam needs to be generated as compared with a laser circulation time (about 10 ns), and the pulse electron beam 1 may therefore be a multi-bunch pulse electron beam.

The pending magnet 14 bends the orbit of the pulse electron beam 1 with a magnetic field, transmits the beam along the predetermined rectilinear orbit 2, and guides the transmitted pulse electron beam 1 to the beam dump 17. A convergence degree of the pulse electron beam 1 is regulated by the Q-magnets 15. The pulse electron beam 1 is decelerated by the deceleration tube 16. The beam dump 17 traps the pulse electron beam 1 transmitted along the rectilinear orbit 2 to prevent leakage of radiation.

A synchronization device 19 executes control so that the electron beam generator 10 is synchronized with the composite laser generator 20, a timing of the pulse electron beam 1 is collided with that of pulse laser light 3 described later and the pulse electron beam 1 collides with the pulse laser light 3 at a collision point 2*a* on the predetermined rectilinear orbit 2.

By the electron beam generator 10 described above, the pulse electron beam 1 of, for example, about 50 MeV, about 1 μs can be generated and transmitted along the predetermined rectilinear orbit 2.

The composite laser generator 20 has a function of successively generating a plurality of pulse laser lights 3 having different wavelengths.

In this example, the laser light introduction device 30 has two mirrors 32, 34. A plurality of pulse laser lights 3 are introduced along the rectilinear orbit 2 so as to collide with the pulse electron beam 1 by the first mirror 32, and the pulse laser light 3 transmitted along the rectilinear orbit 2 is returned to the composite laser generator 20 by the second mirror 34.

The first mirror 32 and the second mirror 34 are total reflection mirrors. In a case where an emitting direction of a monochromatic hard X-ray 4 is the same direction as that of the pulse electron beam 1, the first mirror 32 preferably has the surface formed of a material (e.g., quartz glass) having a high X-ray transmittance and coated with a reflective film, and the first mirror is preferably formed to be thin, so that the monochromatic hard X-ray 4 can be transmitted through the mirror and loss of the ray is sufficiently reduced.

It is to be noted that this constitution is not essential, and in a case where the emitting direction of the monochromatic hard X-ray 4 is different from that of the pulse electron beam 1, both of the first mirror 32 and the second mirror 34 may be formed of a material (e.g., a metal) having a low X-ray transmittance.

Figure 6:
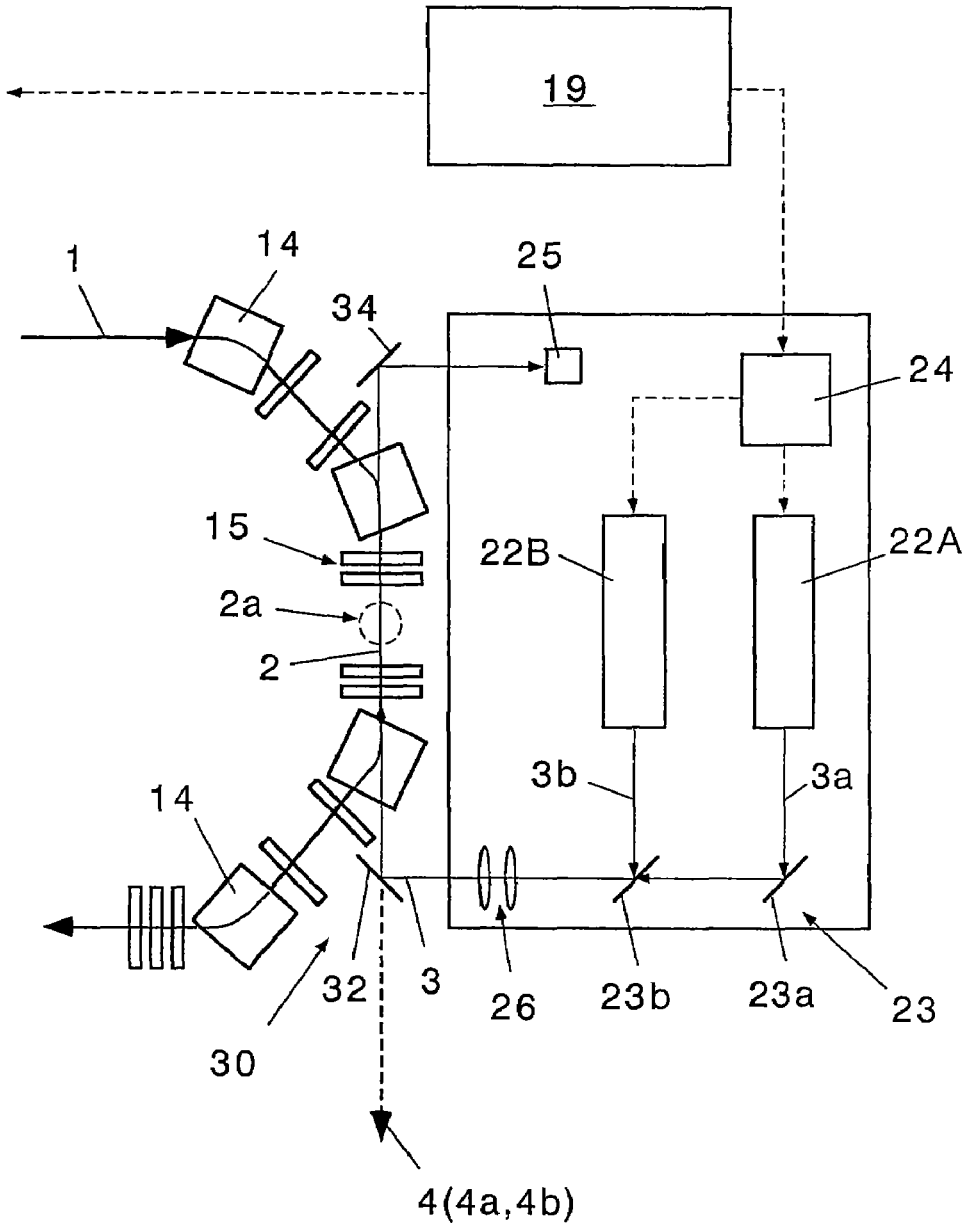
FIG. 6 is a constitution diagram of a main part of FIG. 5.

FIG. 6 is a constitution diagram of a main part of FIG. 5. In this example, the composite laser generator 20 has a plurality of pulse laser units 22A, 22B, a laser combining optical system 23, a laser control unit 24 and a laser dump 25.

The plurality of pulse laser units 22A, 22B generate pulse laser lights 3*a*, 3*b* having different wavelengths. For example, as the pulse laser units 22A, 22B, Nd-YAG laser having a wavelength of 1064 nm, and Nd-YAG laser in which a KTP crystal to convert the wavelength into a half wavelength is incorporated and which has a wavelength of 532 nm are used.

In this example, the laser combining optical system 23 includes a total reflection mirror 23*a* and a half mirror 23*b*. The total reflection mirror 23*a* reflects the pulse laser light 3*a* of the pulse laser unit 22A toward the first mirror 32 of the laser light introduction device 30. The half mirror 23*b* is a half mirror through which the pulse laser light 3*a* can be transmitted as it is and which reflects the pulse laser light 3*b* toward the first mirror 32 of the laser light introduction device 30.

According to this constitution, the plurality of pulse laser lights 3*a*, 3*b* can be combined as the pulse laser light 3 along the same optical path, the pulse laser light can be reflected on the first mirror 32, and the plurality of combined pulse laser lights can be introduced onto the rectilinear orbit 2.

The laser control unit 24 controls the plurality of pulse laser units 22A, 22B so that the plurality of pulse laser lights 3*a*, 3*b* have a time difference. For example, when each of the plurality of pulse laser lights 3*a*, 3*b* has a pulse oscillation number of 10 pps and a pulse width of 10 ns and a pulse oscillation time of one of the beams is displaced, the plurality of pulse laser lights 3*a*, 3*b* having a pulse width of 10 ns (wavelengths of 1064 nm and 532 nm) are alternately output and reflected as the pulse laser light 3 on the first mirror 32.

The laser dump 25 traps the pulse laser light 3 transmitted along the rectilinear orbit 2 to prevent the light from flying and scattering.

According to the above-mentioned constitution of the present invention, the wavelength of the X-ray generated by the collision of the pulse electron beam 1 with the pulse laser light 3 depends on the wavelength of the pulse laser light 3. Therefore, when the plurality of pulse laser lights 3*a*, 3*b* having the different wavelengths are generated by the composite laser generator 20, two or more types of monochromatic hard X-rays 4 (4*a*, 4*b*) can successively be switched and generated at short time intervals.

Moreover, since the pulse laser light 3 head-on collides with the pulse electron beam 1 along the rectilinear orbit 2 to generate the monochromatic hard X-rays, the collision efficiency can be maximized.

Furthermore, the pulse laser units can generate the pulse laser lights in a short period (e.g., 10 pps or more). Therefore, in a case where the laser control unit 24 controls the plurality of pulse laser lights so that the beams have a time difference therebetween, the plurality of pulse laser lights are successively allowed to head-on collide with the pulse electron beam in the short period, and two or more types of the plurality of monochromatic hard X-rays can successively be switched and generated in the short period (e.g., 10 pps or more).

For example, in a case where kinetic energy of the electron beam is set to 35 MeV and Nd-YAG laser having a wavelength of 1064 nm and Nd-YAG laser including the KTP crystal to convert the wavelength into the half wavelength incorporated therein and having a wavelength of 532 nm are used, monochromatic hard X-rays of about 44.5 keV can be emitted.

In this example, the plurality of generated monochromatic hard X-rays 4 (4*a*, 4*b*) pass through the first mirror 32, and are emitted to the outside in the same direction as that of the pulse electron beam 1. It is to be noted that the monochromatic hard X-ray 4 generated at the collision point 2*a* has little directivity, and therefore a collimator may be disposed between the collision point 2*a* and a person 6 being inspected to control the emitting direction of the monochromatic hard X-ray 4 into a direction (e.g., a direction crossing a sheet surface of FIG. 5 at right angles) different from that of the pulse electron beam 1.

The plurality of taken monochromatic hard X-rays 4 (4*a*, 4*b*) can be used in angiography and two-color X-ray CT.

It is to be noted that the number of the pulse laser units is not limited to two, and three or more unit may be used. The pulse laser light is not limited to the above-mentioned example, and ArF (wavelength of 193 nm), KrF (wavelength of 248 nm), XeCl (wavelength of 308 nm), XeF (wavelength of 351 nm) or F2 (wavelength of 157 nm) of excimer laser, a third higher harmonic wave (wavelength of 355 nm), a fourth higher harmonic wave (wavelength of 266 nm) or a fifth higher harmonic wave (wavelength of 213 nm) of YAG laser or the like may be used.

In FIG. 6, a multi-color X-ray generator of the present invention further has a profile regulation optical system 26 between the first mirror 32 and the half mirror 23*b*. This profile regulation optical system 26 is, for example, a composite lens, and regulates a beam profile (e.g., a size, a tilt and a position) of the pulse laser light 3 at the collision position 2*a* of the rectilinear orbit 2.

Figure 7:
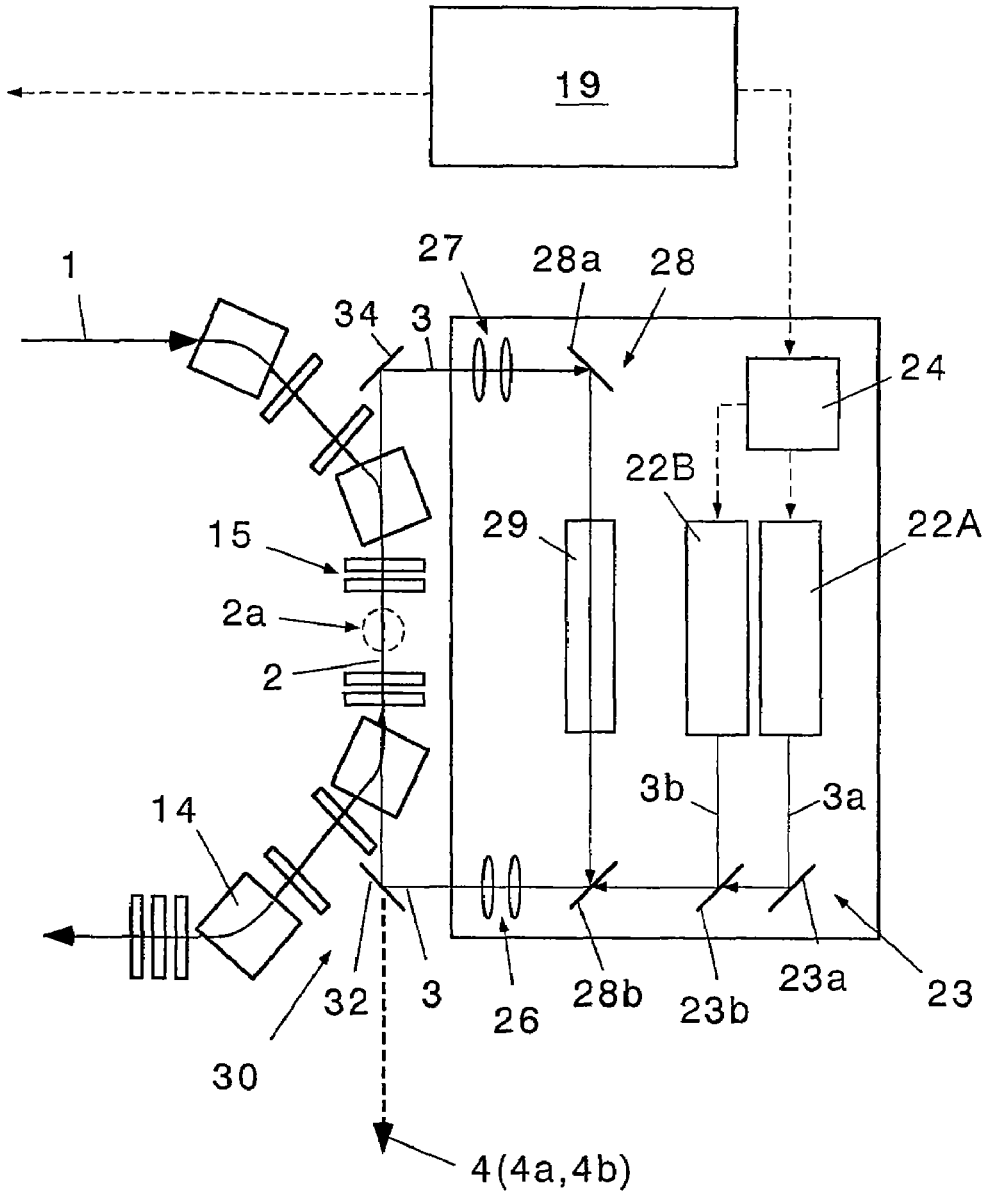
FIG. 7 is a diagram of a second embodiment of the multi-color X-ray generator according to the present invention.

FIG. 7 is a diagram of a second embodiment of a multi-color X-ray generator according to the present invention. In this example, a composite laser generator 20 further has a laser circulation system 28.

In this example, the laser circulation system 28 includes a total reflection mirror 28*a* and a half mirror 28*b*. The total reflection mirror 28*a* reflects pulse laser light 3 transmitted along a rectilinear orbit 2 and reflected by a second mirror 34 toward the half mirror 28*b*. The half mirror 28*b* is a half mirror through which the pulse laser light 3 can be transmitted as it is and which reflects the pulse laser light 3 from the total reflection mirror 28*a* toward a first mirror 32 of a laser light introduction device 30.

According to this constitution, the pulse laser light 3 transmitted along the rectilinear orbit 2 is circulated along an optical path before transmitted along the rectilinear orbit 2, and the same pulse laser light 3 can be circulated to collide with a pulse electron beam 1*a* plurality of times.

Moreover, in this example, a profile regulation optical system 27 is disposed between the second mirror 34 and the total reflection mirror 28*a*. This profile regulation optical system 27 is, for example, a composite lens, and regulates a beam profile (e.g., a size, a tilt and a position) of the pulse laser light 3 reflected toward the half mirror 28*b* and struck on a laser amplifier 29 described later.

In FIG. 7, the composite laser generator 20 has the laser amplifier 29 along the optical circulation path between the total reflection mirror 28*a* and the half mirror 28*b*. This laser amplifier 29 is, for example, a YAG rod which amplifies at least one (preferably all) of a plurality of pulse laser lights 3*a*, 3*b* included in the pulse laser light 3 to reduce or remove loss due to the circulation. It is to be noted that the laser amplifier 29 is not limited to a single amplifier, and the amplifiers may be arranged for the plurality of pulse laser lights 3*a*, 3*b*.

Another constitution is similar to that of the first embodiment of FIGS. 5, 6.

According to the above-mentioned constitution of the present invention, in the same manner as in the first embodiment, since a wavelength of an X-ray generated by collision of the pulse electron beam 1 with the pulse laser light 3 depends on that of the laser light 3. Therefore, when the plurality of pulse laser lights 3*a*, 3*b* having the different wavelengths are generated by the composite laser generator 20, two or more types of monochromatic hard X-rays 4 (4*a*, 4*b*) can successively be switched and generated at short time intervals, and used in angiography and two-color X-ray CT.

Moreover, since the same pulse laser light 3 can be circulated by the laser circulation system 28 to collide with the pulse electron beam 1 a plurality of times, collision efficiency (probability) can be increased, and total energy of laser which contributes to the collision can be increased to, for example, about ten-fold owing to the circulation.

For example, it can be predicted that by use of laser of, for example, a 10 TW class, X-rays of about $1\times10^9$ photons/s can be generated by the circulation.

Furthermore, when the laser amplifier 29 is also used, the total energy of laser which contributes to the collision can be increased to, for example, about 50 times as large as that in a case where the circulation is not performed.

Therefore, according to the present invention, the wavelengths of the X-rays can successively be switched at high speed without physically moving any device or component, a change of a wavelength switch time of a subject can be reduced, resolution of an X-ray image can be improved, and an electron density distribution and an element distribution can highly precisely be obtained.

Moreover, since the wavelength of the X-ray linearly depends on that of the laser light, a timing and energy of the X-ray to be emitted can be specified. Therefore, an X-ray detector can alternately pick up an image owing to the energy of each of two colors.

It is to be noted that the present invention is not limited to the above embodiments, and needless to say, the present invention can variously be modified without departing from the scope of the present invention.

What is claimed is:

1. A multi-color X-ray generator comprising:

(a) an electron beam generator that accelerates a pulse electron beam to transmit the pulse electron beam along a predetermined rectilinear orbit;

(b) a composite laser generator that successively generates a plurality of pulse laser lights having different wavelengths on a same optical path; and (c) a laser light introduction device that introduces the plurality of pulse laser lights along the rectilinear orbit to collide with the pulse electron beam, wherein the plurality of pulse laser lights are allowed to collide head-on with the pulse electron beam along the rectilinear orbit to generate two or more types of monochromatic hard X-rays.

2. The multi-color X-ray generator according to claim 1, wherein the composite laser generator comprises:

(i) a plurality of pulse laser units that generate the plurality of pulse laser lights having the different wavelengths;

(ii) a laser combining optical system that combines the plurality of pulse laser lights along the same optical path; and (iii) a laser control unit that controls the plurality of pulse laser units so that the plurality of pulse laser lights have a time difference.

3. The multi-color X-ray generator according to claim 2, further comprising:

(d) a profile regulation optical system that regulates a beam profile of the pulse laser light at a collision point along the rectilinear orbit.

4. The multi-color X-ray generator according to claim 2, wherein the composite laser generator further comprises:

(iv) a laser circulation system having the same optical path, wherein the laser circulating system circulates the pulse laser light transmitted along the rectilinear orbit, along the same optical path, and wherein the pulse laser light is transmitted along the rectilinear orbit first before entering the laser circulating system, and then is circulated along the same optical path to collide with the pulse electron beam a plurality of times.

5. The multi-color X-ray generator according to claim 4, further comprising:

(e) a laser amplifier that amplifies the pulse laser light along the same optical path along which the pulse laser light is circulated.

* * * * *

UNITED STATES PATENT AND TRADEMARK OFFICE

CERTIFICATE OF CORRECTION

PATENT NO. : 7,724,876 B2
APPLICATION NO. : 11/913975
DATED : May 25, 2010
INVENTOR(S) : Hiroyuki Nose et al.

It is certified that error appears in the above-identified patent and that said Letters Patent is hereby corrected as shown below:

Title Page item 56 under the section of "Other Publications", please change the author's name from "Dohashi, Katsunori" to --Dobashi, Katsuhiro--.

Signed and Sealed this
Fourteenth Day of June, 2011

David J. Kappos

David J. Kappos
*Director of the United States Patent and Trademark Office*